US006581724B2

(12) United States Patent
Dutton et al.

(10) Patent No.: US 6,581,724 B2
(45) Date of Patent: Jun. 24, 2003

(54) SOUND ABSORBING CLOSURE PANELS FOR SOUND ISOLATION MODULES

(75) Inventors: Steven Dutton, Austin, TX (US); John Phillips, Austin, TX (US)

(73) Assignee: Acoustic Systems, Inc., Austin, TX (US)

( * ) Notice: Subject to any disclaimer, the term of this patent is extended or adjusted under 35 U.S.C. 154(b) by 0 days.

(21) Appl. No.: 09/843,989

(22) Filed: Apr. 27, 2001

(65) Prior Publication Data

US 2002/0157898 A1 Oct. 31, 2002

(51) Int. Cl.[7] ..... E04B 1/00

(52) U.S. Cl. ..... 181/285; 181/284; 181/290; 181/295

(58) Field of Search ..... 181/285, 284, 181/290, 295, 287, 30

(56) References Cited

U.S. PATENT DOCUMENTS 3,333,524 A * 8/1967 Mariner ..... 454/296
3,729,889 A * 5/1973 Baruzzini ..... 52/264

* cited by examiner

*Primary Examiner*—Shih-Yung Hsieh

(57) ABSTRACT

The invention provides a method for acoustic closure of an installation of a row of sound isolation modules within a host building encompassing the modules. One or more acoustic absorbing closure panels are mounted to form a partition in front of the row of modules, thus forming two acoustically separate regions. The absorbing panels are comprised of one or more sound absorbing materials between a front and rear surface. The front surface faces the region exterior to the installation within the host building. The rear surface faces the installation.

13 Claims, 4 Drawing Sheets

SOUND ABSORBING CLOSURE PANELS FOR SOUND ISOLATION MODULES

TECHNICAL FIELD OF THE INVENTION

The present invention relates to the field of installation of sound isolation modules within a host building, and more particularly to enclosure of the modules.

BACKGROUND OF THE INVENTION

Acoustic enclosures are used in a variety of applications. In particular, modular acoustic enclosures are used as sound isolation modules to insulate sound generated inside the room from the exterior environment and to insulate the interior of the room from sound generated in the exterior environment. For example, many high schools and music schools provide sound isolation modules for music practice, enabling a plurality of music students, each one in a separate module, to simultaneously play his or her instrument without acoustical interference from music generated in another enclosure or from sound generated in an environment exterior to the sound isolation module.

Each sound isolation module thus forms a separate acoustic enclosure. A plurality of panels, each panel comprising one or more acoustic absorbing materials enclosed by steel or other rigid structure, are assembled to form the enclosure, including a door allowing access thereto. Often, a window is provided to allow one to see inside or outside the module. The modules thus formed are typically placed in a row within a host building, each module having a separate door enabling separate access to each one of them from the exterior environment within the host building.

When the modules are placed in a row, gaps exist between adjacent modules, between the modules and the ceilings of the host building, and between the modules on the ends of the row and the walls of the host building adjacent to the end modules. To cover these gaps and to provide a uniform, or decorative, finished appearance exterior to the modules a covering is employed formed of partitions referred to as closure panels. The closure panels are usually formed of steel, sheetrock, laminated wood products or other suitable material. In addition to providing a finished appearance, provisions for ventilation can be incorporated into the closure panels to allow air to circulate there through to satisfy heating and air conditioning requirements while still maintaining the same outward appearance.

Such an installation provides large acoustically reflective surfaces that cause reverberations in the exterior area within the host building. Sound waves will penetrate the closure panels and reverberate against the panels and windows forming the fronts of the modules and will also penetrate the closure panels and reverberate in the gaps between the modules and between the modules and the walls and ceilings of the host building. This results in undesirable acoustic effects which building managers, acousticians and architects seek to minimize in a variety of ways. One commonly employed solution is to mount sound absorbing panels to the exterior of the closure panels. These sound absorbing panels are frequently covered with fabric to provide a more decorative appearance. Unfortunately, such after-applied solutions add to the cost of the installation and are vulnerable to vandalism.

Thus, there is a need for methods and systems that overcome these and other limitations of the prior art.

SUMMARY OF THE INVENTION

The present invention provides methods and systems for installing sound absorbing closure panels for sound isolation module installations that overcome prior art limitations.

According to one aspect of the invention one or more partitions are formed of acoustic absorbing material that provide sound absorbing closure panels to finish the installation of a plurality of sound isolation modules, thus eliminating the need for supplemental application of acoustic absorbing material to the installation.

The present invention provides a method for acoustic closure of an installation of one or more sound isolation modules within a host building encompassing the modules. One or more acoustic absorbing closure panels are mounted to form a partition in front of the modules, thus forming two acoustically separate regions. The absorbing panels are comprised of one or more sound absorbing materials between a front and rear surface. The front surface faces the region exterior to the installation within the host building. The rear surface faces the installation of the sound isolation modules.

The front surface of a closure panel is comprised of a material that enables sound from the region exterior to the installation within the host building to penetrate into the panel and be at least partially absorbed by the sound absorbing materials there within. The rear surface may also be comprised of material that enables sound from the installation region to penetrate into the panel and be at least partially absorbed by the sound absorbing materials within the panel. Alternatively, the rear surface may be comprised of a sound-reflecting material that reflects sound, so that sound from the installation region cannot penetrate into the region exterior to the installation within the host building. Ventilation passages may be formed through one or more of the panels to enable air to pass through when such ventilation is required or desirable.

The foregoing has outlined rather broadly the features and technical advantages of the present invention in order that the detailed description of the invention that follows may be better understood. Additional features and advantages of the invention will be described hereinafter. It should be appreciated by those skilled in the art that the disclosure provided herein may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
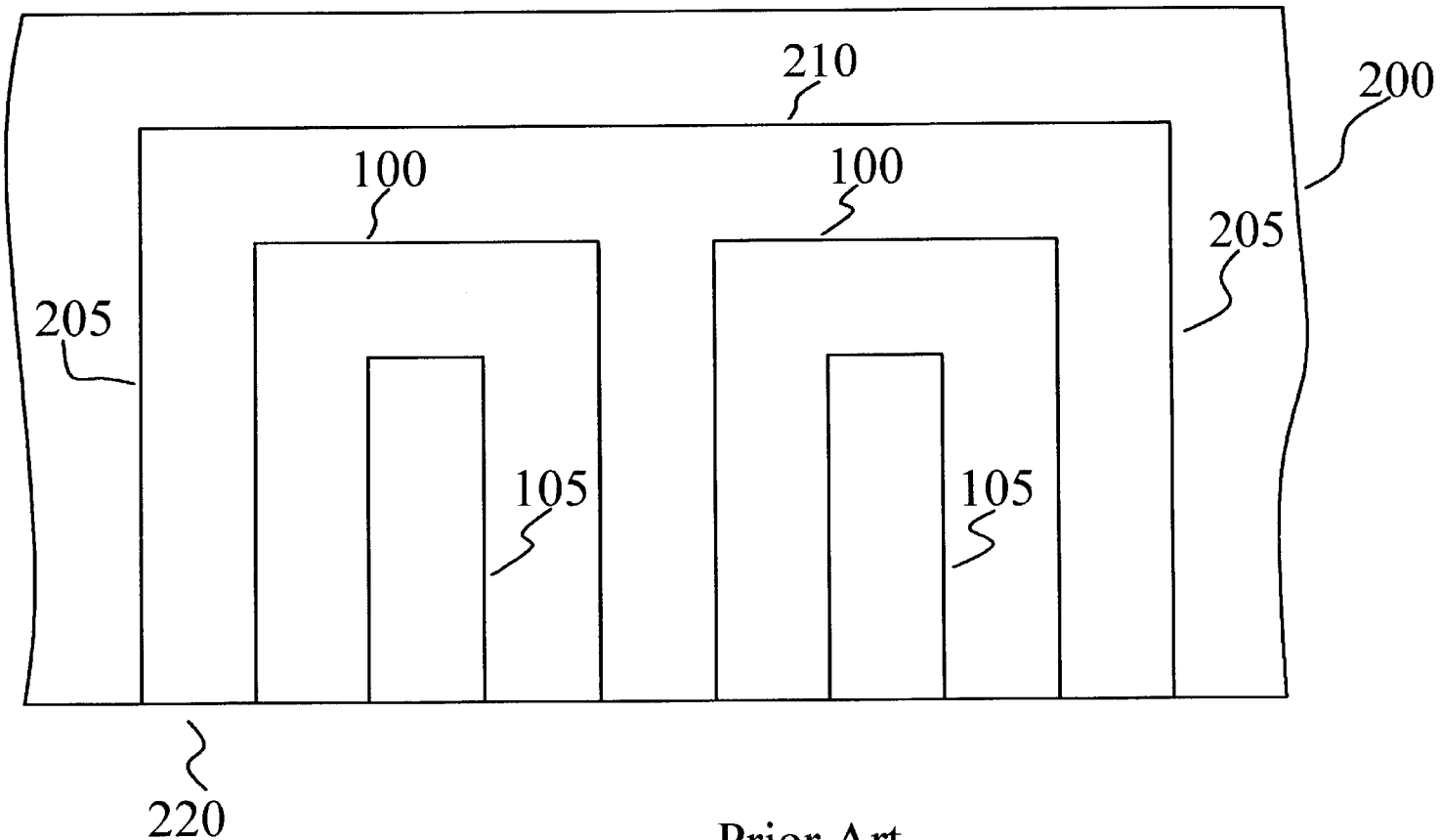
Prior Art Fig. 1
FIG. 1 shows a front view of a typical installation of sound isolation modules within a host building.

FIG. 1 shows a front view of a typical sound isolation module installation comprising a row of one or more sound isolation modules 100 inside a host building 200. The module installation is surrounded on the top by a ceiling 210 of host building 200, on the bottom by a floor 220 of host building 200, on the sides by side walls 205 of host building 200, and on the rear by a rear wall of host building 200 not shown. The one or more modules 100 are fitted with doors 105 to allow passage between the interior and exterior of modules 100.

Figure 2:
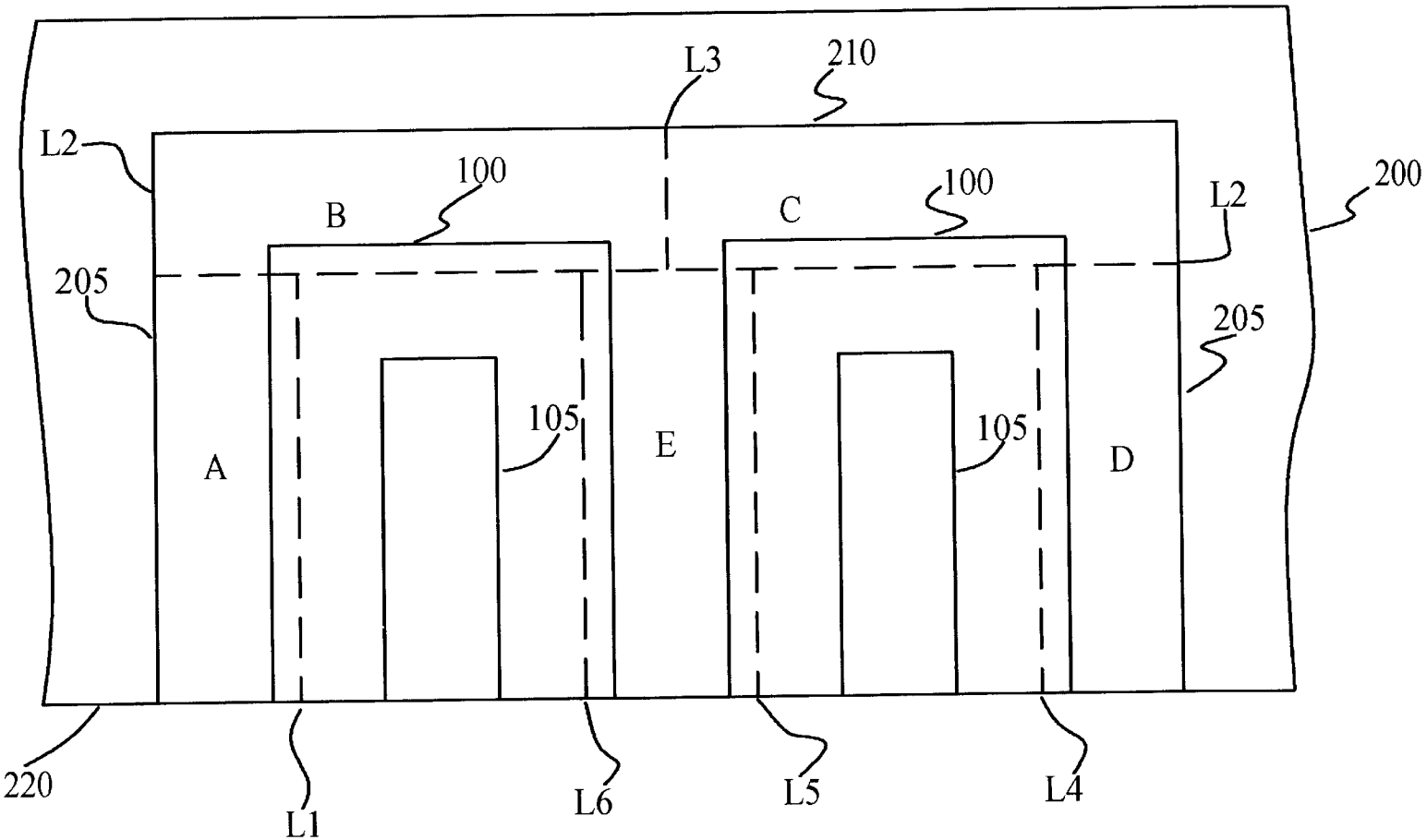
FIG. 2 illustrates a front view of a preferred embodiment of the positions of a plurality of sound absorbing closure panels installed according to the methods of the present invention.

In a typical installation, the row of modules 100 will comprise at least one, and usually, a plurality of such modules. The modules may face outward into a passageway of host building 200 or may face a large open room within host building 200. In between the modules 100 and host building 200 are spaces that are desirably closed by acoustic closure panels according to the methods of the present invention. FIG. 2 illustrates the positions of five acoustic closure panels, indicated by the letters A, B, C, D, and E, employed to form acoustically separate regions, one region being in front of and exterior to the installation region and within the host building, the other region being the installation region itself. The installation region comprises the modules 100, the spaces between modules 100, and between modules 100 and host building 200. Additional acoustic closure panels will be employed when additional modules 100 are included in the installation as can be recognized from the disclosure herein.

Panel A is bound on the left by host building side wall 205 and has a width sufficient to partially extend past the nearest wall of a module 100, as indicated by the leftmost vertical dashed line, L1. The overlap of Panel A and the front wall of the nearest module allows for the acoustic closure panel to be secured to the front wall of the nearest module. Panel A is bound on the bottom by the host building floor 220 and has a height sufficient to extend near to the top of a module 100, as indicated by the horizontal dashed line, L2.

Similarly, Panel D is bound on the right by host building sidewall 205 and has a width sufficient to partially extend past the nearest wall of a module 100, as indicated by the rightmost vertical dashed line, L4. The overlap of Panel D and the front wall of the nearest module allows for the acoustic closure panel to be secured to the front wall of the nearest module. Panel D is bound on the bottom by host building floor 220 and has a height sufficient to extend near to the top of a module 100, as indicated by the horizontal dashed line, L2.

Panel E is bound on the left by the vertical dashed line, L6, and bound on the right by the vertical dashed line, L5. The overlap of Panel E and the front walls of the nearest modules allows for the acoustic closure panel to be secured to the front walls of the nearest modules. Panel E is bound on the bottom by host building floor 220 and has a height sufficient to extend near to the top of a module 100, as indicated by the horizontal dashed line, L2.

Panel B is bound on the left by host building side wall 205 and extends to the dashed vertical line, L3. Panel B is bound on the top by host building ceiling 210 and is bound on the bottom by horizontal dashed line L2. The overlap of Panel B and the front walls of the modules allows for the acoustic closure panel to be secured to the front walls of the module.

Similarly, panel C is bound on the right by host building side wall 205 and extends to the vertical dashed line, L3. Panel C is bound on the top by host building ceiling 210 and is bound on the bottom by horizontal dashed line L2. The overlap of Panel C and the front walls of the modules allows for the acoustic closure panel to be secured to the front walls of the module.

The panels that have a side bounded by a wall 205 or ceiling 210 of host building 200 may be mounted to the that wall or ceiling by sliding the panel into a rail mounted to that wall or that ceiling for the purpose of securing the panel into position. The opposite side of such panel is secured into position by securing it to the front face of a module 100 of which it overlaps, using any convenient securing means such as screws. Other methods for securing the panels, A, B, C, D, and E will readily be recognized by persons of skill in the art, and may, for example, be selected according to the type of structure that comprises host building walls 205 and ceiling 210.

Figure 3:
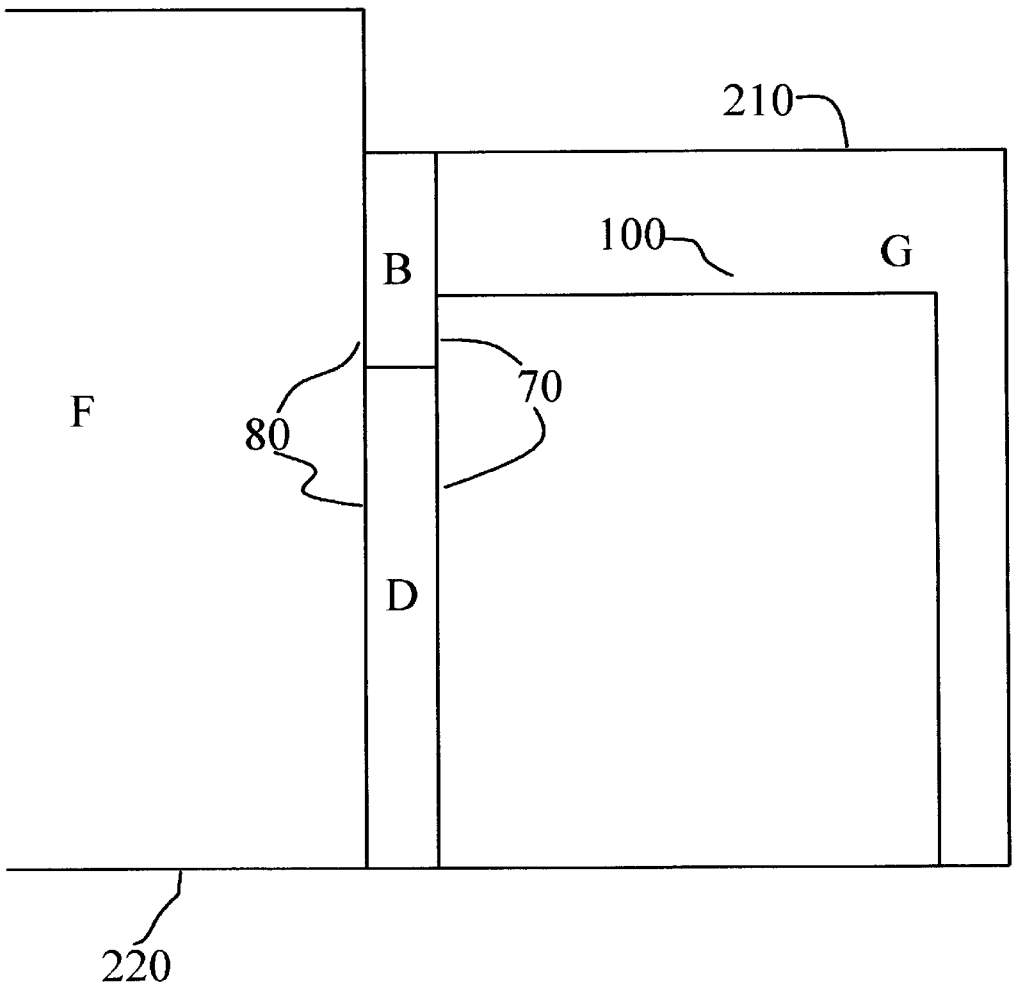
FIG. 3 illustrates a side view of a preferred embodiment of the placement of sound absorbing closure panels according to the methods of the present invention, illustrating the acoustically separate regions formed by the installation of the sound absorbing closure panels.

FIG. 3 illustrates a side view of the installation of the row of modules 100 shown in FIG. 2, with an edge of acoustic closure panels B and D in view. As shown, acoustic the acoustic closure panels installed according to the present invention form two acoustically separate regions, denoted F and G in FIG. 3. Region G is the installation region, which comprises the space between the modules 100 and the host building walls and ceiling, and the space between the modules 100. Region F is the region interior to host building 200 but exterior to the installation region G.

The acoustic closure panels act to absorb sound that penetrates into them from region F or G. Persons of skill in the art will recognize that a sound absorbing panel of practical thickness will not absorb all of the acoustic energy that penetrates into the sound absorbing panel. If sound penetrates through a front wall 80 of a closure panel from region F, some of that sound will be absorbed and could then propagate into region G or be reflected off the front walls of modules 100 or a rear wall 70 of the closure panel back toward region F. If sound reflects off the front walls of modules 100 or rear wall 70 back toward region F, then some of that sound will be absorbed as it propagate through the closure panel and some of that sound will penetrate through front wall 80 into region F. Note that to reduce reflection of sound from the front walls of modules 200, panels A, E, and D can extend to cover as much of the front walls of modules 200 as desirable.

Similarly, if sound penetrates through rear wall 70 of a closure panel from region G, some of that sound will be absorbed and could then propagate into region F or be reflected off front wall 80 of the closure panel back toward region G. If sound reflects off the front wall 80 back toward region G, then some of that sound will be absorbed as it propagate through the closure panel and some of that sound will penetrate through rear wall 70 into region G.

In certain installations, the ceiling of the host building is so high that it is impractical for panels B and C to extend to the ceiling. In such cases, panels B and C will extend upward to a practical extent, allowing a dropped ceiling to be installed at a practical height. Then the panels B and C may be secured to the lower edge of the dropped ceiling. Additionally, if a dropped ceiling is not practical or planned, then panels B and C can be installed "free standing", not affixed to the host ceiling in any manner.

The acoustic closure panels are constructed of one or more sound absorbing materials enclosed by a rigid structure that forms front and rear walls 70 and 80. In a preferred embodiment, the rigid structure is painted 22 gauge, perforated steel, which enables sound to penetrate the closure panel and be at least partially absorbed by the acoustic absorbing content there within. This material will typically match the material used in the interior of the sound modules 100. When a rigid structure enclosing the sound absorbing materials allows sound to penetrate from region F and region G, the acoustic closure panels will absorb sound propagating from either region.

As noted, for a sound absorbing closure panel of practical thickness, a portion of the sound energy propagating from region G into the acoustic closure panels may not be absorbed and thereby continue to propagate into region F. An alternative embodiment may be employed when it is desirable to substantially inhibit sound within region G from propagating into region F. This is accomplished by enclosing each acoustic closure panel on a front side with material that enables sound to penetrate from region F to be absorbed within the panel, and enclosing each acoustic closure panel on a rear side with a sound-reflecting surface creating a barrier to substantially inhibit sound from region G from penetrating into the acoustic closure panel. Finally, if ventilation is required between region G and region F, then ventilation passages may be formed in the acoustic closure panels to allow air to pass there through.

Figure 4:
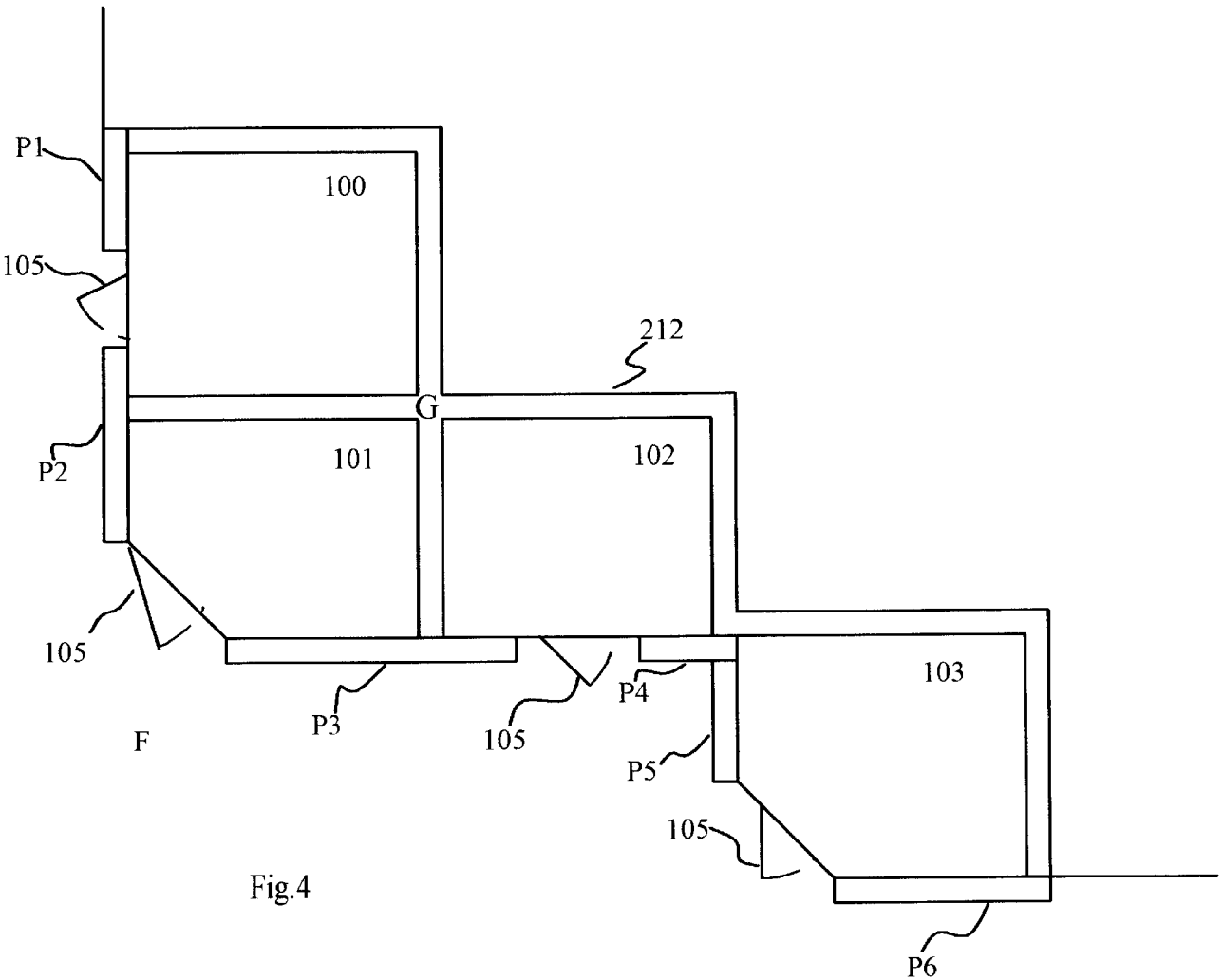
FIG. 4 shows a plan view of an installation of modules to which acoustic closure panels are applied according to the methods of the present invention.

The methods of the present invention may also be applied to sound isolation installations of arbitrary configuration. For example, FIG. 4 shows a plan view of an installation of sound isolation modules 100 to which the methods of the present invention may be advantageously applied. Sound isolation modules 100, 101, 102, and 103 bounded by a non-planar wall 212 of building 200 form the installation. Each module has a door 105 that opens into an interior space of building 200. Acoustic closure panels, P1, P2, P3, P4, P5 and P6 are installed to provide acoustic closure for the installation, partitioning the interior of the host building into a region, G, comprising the installation and a region, F, excluding the installation.

The construction and principles of operation of the acoustic enclosure formed by acoustic closure panels P1 through P6 are the same as described above for the installation and closure panels shown in FIG. 2. The panels absorb sound that would otherwise be reflected from the walls of the isolation modules 100 into region F, and absorb or reflect sound propagating toward region F from region G. Persons of ordinary skill in the art will readily recognize how to make and use the invention applied to other installation configurations given the disclosure herein.

Although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. An apparatus for providing acoustic closure for an installation of one or more sound isolation modules within a host building encompassing the modules, comprising one or more sound absorbing closure panels mounted to acoustically partition a first region from a second region; the first region being exterior to the installation and within the host building, the second region comprising space between sound isolation modules and the space between sound isolation modules and one or more walls of the host building;

one or more of the absorbing panels comprising one or more sound absorbing materials between a first surface and a second surface; the first surface facing the first region and comprised of a material that enables sound from the first region to propagate into the one or more absorbing materials to be at least partially absorbed thereby.

2. The apparatus of claim 1, wherein the second surface of an absorbing panel faces the second region and is comprised of a material that enables sound from the second region to propagate into the one or more absorbing materials to be at least partially absorbed thereby.

3. The apparatus of claim 1, wherein the second surface of an absorbing panel faces the second region and is comprised of a sound-reflecting material to reflect sound propagating in the second region, thereby preventing sound from propagating from the second region into the first region.

4. The apparatus of claim 1, wherein the first surface comprises 22 gauge, perforated steel.

5. A method for providing acoustic closure for an installation of one or more modules within a host building encompassing the modules, comprising the steps of:

providing one or more acoustic absorbing panels mounted to acoustically partition a first region from a second region; the first region being interior to the host building and exterior to the second region, the second region comprising space between sound isolation modules and the space between sound isolation modules and one or more walls of the host building;

wherein one or more of the absorbing panels are comprised of one or more sound absorbing materials between a first surface and a second surface; the first surface racing the first region and comprising a material that enables sound from the first region to propagate into the one or more absorbing materials to be at least partially absorbed thereby.

6. The method of claim 5, wherein the second surface of an absorbing panel faces the second region and is comprised of a material that enables sound from the second region to propagate into the one or more absorbing materials to be at least partially absorbed thereby.

7. The method of claim 5, wherein the second surface of an absorbing panel faces the second region and is comprised of an acoustic reflecting material to reflect sound propagating in the second region, thereby substantially inhibiting sound from propagating from the second region into the first region.

8. The method of claim 5, wherein the first surface comprises 22 gauge, perforated steel.

9. A sound module system comprising:

An installation of one or more sound isolation modules within a host building, the modules partially bounded by a floor and walls of the host building, and further partially bounded by an acoustic partition comprising a plurality of sound absorbing closure panels, the acoustic partition comprising an acoustically penetrable surface to enable sound to penetrate from a region exterior to the installation into an interior volume of the partition, the partition separating the region exterior to the installation from the region between the one or more modules and the walls and floors bounding the one or more modules within the installation;

the interior volume of the partition comprising sound absorbing material to enable sound that penetrates into the interior volume to be at least partially absorbed thereby.

10. The installation of claim 8, wherein the acoustic partition further comprises a second acoustically penetrable surface to enable sound to penetrate from a region interior to the installation into the interior volume of the partition to be at least partially absorbed thereby.

11. The installation of claim 9, wherein sound reflected from a wall of a module penetrating into the interior volume of the partition is at least partially absorbed thereby.

12. The installation of claim 9, wherein the acoustic partition further comprises a sound-reflecting surface to reflect sound interior to the installation.

13. The installation of claim 9, wherein an acoustically penetrable surface comprises perforated steel.

* * * * *